US008179267B2

(12) United States Patent
Anderson et al.

(10) Patent No.: US 8,179,267 B2
(45) Date of Patent: May 15, 2012

(54) PINLESS SECURITY DEVICE

(75) Inventors: Luis E. Anderson, Boca Raton, FL (US); Oscar Rendon, Coral Springs, FL (US)

(73) Assignee: Sensormatic Electronics, LLC, Boca Raton, FL (US)

( * ) Notice: Subject to any disclaimer, the term of this patent is extended or adjusted under 35 U.S.C. 154(b) by 300 days.

(21) Appl. No.: 12/465,224

(22) Filed: May 13, 2009

(65) Prior Publication Data

US 2010/0287998 A1 Nov. 18, 2010

(51) Int. Cl.
*G08B 13/14* (2006.01)

(52) U.S. Cl. ..... 340/572.9; 70/14; 190/120

(58) Field of Classification Search .... 340/572.1–572.9; 70/14–30, 57, 57.1, 58, 262, 66; 190/120
See application file for complete search history.

(56) References Cited

U.S. PATENT DOCUMENTS

| | | | | |
|---|---|---|---|---|
| 6,705,133 | B1 * | 3/2004 | Avganim | 70/14 |
| 2008/0072633 | A1 * | 3/2008 | Samuel | 70/58 |
| 2009/0044578 | A1 * | 2/2009 | Boss et al. | 70/57 |
| 2011/0072862 | A1 * | 3/2011 | Avganim et al. | 70/58 |
| 2011/0122551 | A1 * | 5/2011 | Hung et al. | 361/679.01 |

FOREIGN PATENT DOCUMENTS

| | | | |
|---|---|---|---|
| GB | 2150207 | A * | 6/1985 |
| GB | 2150207 | A1 | 6/1985 |
| GB | 2305212 | A * | 4/1997 |
| GB | 2305212 | A1 | 4/1997 |
| WO | 2008/068725 | A2 | 6/2008 |

OTHER PUBLICATIONS

International Search Report and Written Opinion dated Sep. 7, 2009 for International Application No. PCT/US2009/003034, International Filing Date May 15, 2009 consisting of 12-pages.

* cited by examiner

*Primary Examiner* — George Bugg
*Assistant Examiner* — Edny Labbees
(74) *Attorney, Agent, or Firm* — Alan M. Weisberg; Christopher & Weisberg, P.A.

(57) ABSTRACT

A security device is removably affixable to an article. The security device includes a housing having a securing pad, a locking element and a strap. The locking element is disposed within the housing. The strap includes a first end having a latching region that is insertable into the housing and a second end having a securing region. The strap is slidingly movable between an open position and a locked position. The locking element engages with the latching region of the strap. When in the locked position, the strap secures the article between the securing pad and the securing region of the strap.

21 Claims, 8 Drawing Sheets

PINLESS SECURITY DEVICE

CROSS-REFERENCE TO RELATED APPLICATION n/a

STATEMENT REGARDING FEDERALLY SPONSORED RESEARCH OR DEVELOPMENT n/a

FIELD OF THE INVENTION

The present invention relates generally to Electronic Article Surveillance ("EAS") systems for the prevention of unauthorized removal of an item from a controlled area, and more particularly to a pinless EAS security tag that securely attaches to an item of merchandise without penetrating the item.

BACKGROUND OF THE INVENTION

A typical Electronic Article Surveillance ("EAS") system in a retail setting may comprise a monitoring system and one or more security tags or labels attached to articles to be protected from unauthorized removal. The monitoring system establishes a surveillance zone (also referred to as an interrogation zone), usually at an access point for the controlled area. Articles which are authorized for removal from the area can be deactivated or removed so as not be detectable by the monitoring system. If the monitored item enters the surveillance zone with an active security tag, an alarm may be triggered to indicate possible unauthorized removal of the item.

As is known in the art, security tags (also referred to as labels) for EAS systems can be constructed in any number of configurations. The desired configuration of the tag or label is often dictated by the nature of the article to be protected. For example, pre-packaged goods which are subject to retail theft, such as CDs, DVDs, small electronic devices, etc., may contain an EAS label disposed within the packaging in such a way that it is hidden from the consumer at least during the pre-purchase period.

An EAS label may be enclosed in a rigid housing which can be secured to the monitored item, such as hard tags containing EAS labels which are commonly attached to clothing in retail stores. The rigid housing typically includes a pin which is inserted through the fabric and secured in place on the opposite side. The housing cannot be removed from the clothing without destroying the housing except by using an EAS deactivator/remover.

However, by inserting the pin through the fabric, the item to be protected incurs some damage from the pin. High-end retailers and customers dislike having expensive merchandise, such as, for example, leather goods, suffer some damage in order to prevent theft. Shoes are especially difficult to protect using a device having a pin as the material the shoe is constructed from often suffers permanent damage from the pin.

Additionally, shoes present other difficulties for EAS tags having a pin because the shoe material may simply be too rigid to insert the pin. Many retailers currently attempt to secure their merchandise using these hard tags in combination with pins, lanyards or both through a lace eyelet or in the tongue area. This practice is fine for a few shoe types, but the tag/pin/lanyard interferes with the fitting and lacing process of the merchandise. Thus, many shoes, boots and expensive or strapped women's shoes cannot be tagged at all. For items such as boots, pin may be too short to extend through the thickness of the boot material, thereby preventing the pin from being secured.

Therefore, what is needed is a pinless EAS security device that is attachable to items of merchandise without penetrating through or damaging the item.

SUMMARY OF THE INVENTION

The present invention advantageously provides a pinless Electronic Article Surveillance ("EAS") security device, system and method for attaching the pinless EAS security device to an article of merchandise. The pinless EAS security device protects the article from being removed from a monitored area without penetrating the article.

In accordance with one aspect of the present invention, a security device is removably affixable to an article. The security device includes a housing, a locking element and a strap. The housing includes a securing pad. The locking element is disposed within the housing. The strap includes a first end having a latching region that is insertable into the housing and a second end having a securing region. The strap is slidingly movable between an open position and a locked position. The locking element is engageable with the latching region of the strap. The strap, when in the locked position is at least partially retained within the housing and secures the article between the securing pad and the securing region of the strap.

In accordance with another aspect of the present invention, an electronic article EAS system for securing an article includes an EAS security device and a magnetic detacher. The EAS security device includes a housing, a strap and a locking element. The housing includes a securing pad and a protrusion. The strap includes a first end having a latching region that is insertable into the housing and a second end having a securing region. The locking element includes a magnetically actuable latch and a flexible locking element. The magnetically actuable latch is disposed within the protrusion of the housing. The flexible locking element biases the magnetically actuable latch and the latching region of the strap into a locked position. The stra is slidingly movable between an open position and a locked position. The locking element is engageable with the latching region of the strap. The strap, when in the locked position is at least partially retained within the housing and secures the article between the securing pad and the securing region of the strap. The magnetic detacher includes a detaching zone operable to nest the protrusion of the housing therein for detaching the EAS security device from the article.

In accordance with yet another aspect of the present invention, a method is provided for protecting an article from theft. A security device is affixed to a portion of the article. The security device includes a housing, a locking element and a strap. The housing includes a securing pad. A locking element is disposed within the housing. The strap includes a first end having a latching region that is insertable into the housing and a second end having a securing region. The strap is slidingly moved from an open position to a locked position. The locking element engages with the latching region of the strap.

BRIEF DESCRIPTION OF THE DRAWINGS

A more complete understanding of the present invention, and the attendant advantages and features thereof, will be more readily understood by reference to the following detailed description when considered in conjunction with the accompanying drawings wherein.

DETAILED DESCRIPTION OF THE INVENTION

Figure 1:
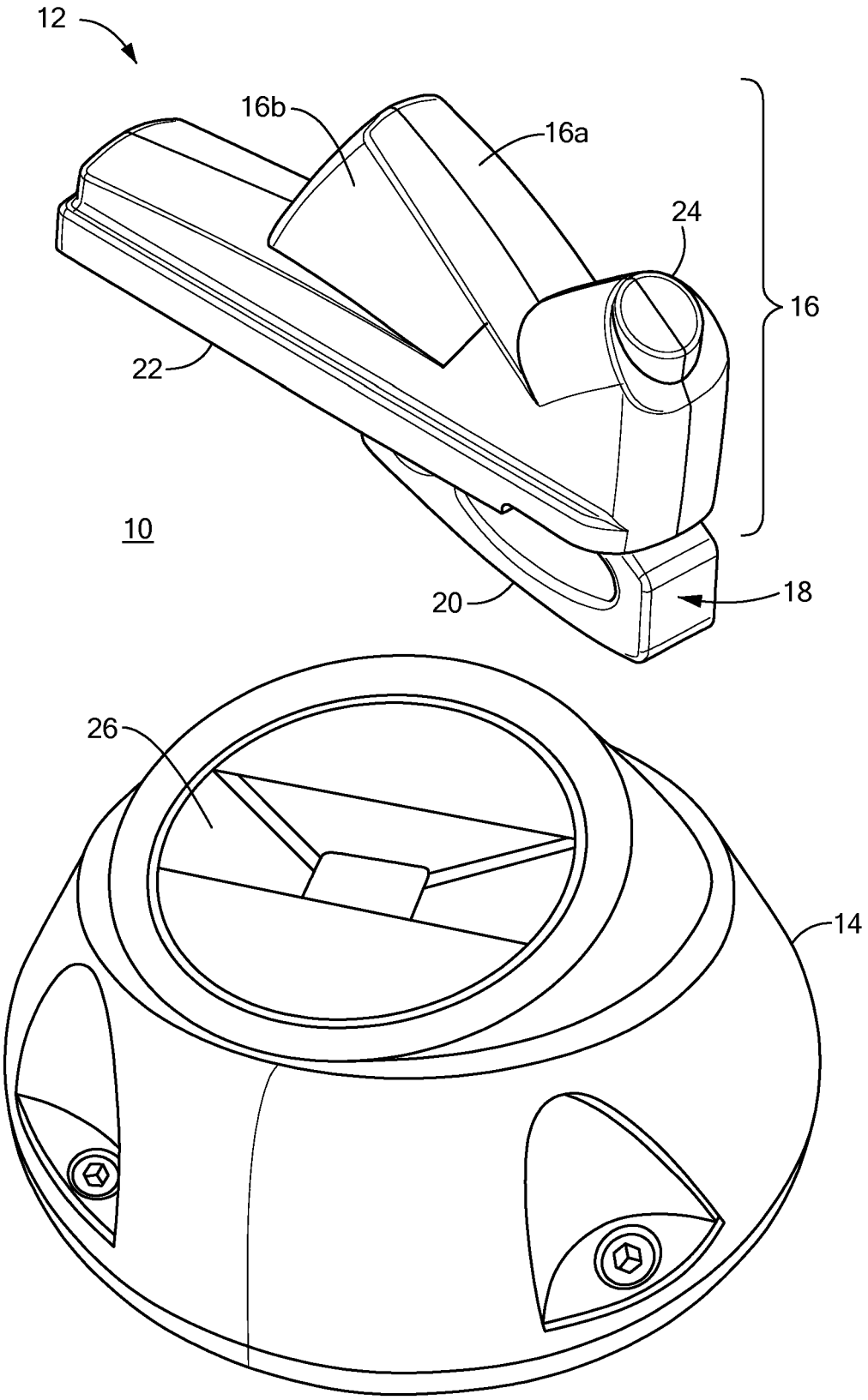
FIG. 1 illustrates components of a pinless electronic article surveillance ("EAS") security device and system, in accordance with one embodiment of the present invention.

Before describing in detail exemplary embodiments that are in accordance with the present invention, it is noted that the embodiments reside primarily in combinations of apparatus components and processing steps related to implementing apparatuses, systems and methods for securing a pinless EAS security device to items of merchandise without penetrating through or damaging the item. Accordingly, the system and method components have been represented where appropriate by conventional symbols in the drawings, showing only those specific details that are pertinent to understanding the embodiments of the present invention so as not to obscure the disclosure with details that will be readily apparent to those of ordinary skill in the art having the benefit of the description herein.

As used herein, relational terms, such as "first" and "second," "top" and "bottom," and the like, may be used solely to distinguish one entity or element from another entity or element without necessarily requiring or implying any physical or logical relationship or order between such entities or elements.

One embodiment may include, for example, a pinless EAS security device comprising a securing mechanism, locking mechanism, security tag, and a housing. The securing mechanism may comprise a strap and a securing pad. The strap may be any suitable materials, such as metal or plastic and may be rigid or flexible. The strap includes a securing side and latching side. The securing side of the strap may extend outward from the housing and secure the pinless EAS security device to an item by entrapping a portion of an article between the strap and the securing pad. The locking mechanism may include a magnetically actuable latch and a flexible element that biases the magnetically actuable latch toward a locking position. The latching side of the strap mates with at least a portion of the magnetically actuable latch in the locking position. As used herein, the "locking position" may refer to the position of the magnetically actuable latch in which it is partially or fully within a void of, in engagement with, joined with, or otherwise mated with the latching side of the strap. The housing may be a structure configured to secure the locking mechanism, security tag, securing mechanism, and the article to the housing. As secured, the magnetically actuable latch of the locking mechanism may mate with the latching side of the strap in the locking position to lock the housing, and thus the security tag with which the housing is secured, to the article. When the housing is locked, the security device may prevent or provide resistance to an attempt to separate the housing from the article.

It is worthy to note that any reference in the specification to "one embodiment" or "an embodiment" means that a particular feature, structure, or characteristic described in connection with the embodiment is included in at least one embodiment. The appearances of the phrase "in one embodiment" in various places in the specification are not necessarily all referring to the same embodiment.

Numerous specific details may be set forth herein to provide a thorough understanding of the embodiments. It will be understood by those skilled in the art, however, that the embodiments may be practiced without these specific details. In other instances, well-known methods, procedures and components have not been described in detail so as not to obscure the embodiments. It can be appreciated that the specific structural and functional details disclosed herein may be representative and do not necessarily limit the scope of the embodiments.

Referring now in detail to the drawings wherein like parts are designated by like reference numerals throughout, there is illustrated in FIG. 1 a perspective view of components that may be included in an EAS security system 10 in accordance with one embodiment. In this embodiment, the security system 10 includes the security device 12 and a detacher 14 used to remove the security device 12 when attached to an item of merchandise. The pinless EAS security device 12 may include a housing 16 having two conjoining halves 16*a*, 16*b* molded from a polymer and/or another rigid material or materials. A securing mechanism 18, such as a stra 20, is movable between an open position and a locked position. When security device 12 is attached to an article, the strap 20 is moved to the closed position where the article is trapped or sandwiched between the strap 20 and a securing side 22 of the housing 16.

The housing 16 further includes a protrusion 24 designed to fit into an indented detaching zone 26 of the magnetic tag detacher 14 in order to remove the pinless EAS security tag 12 from the protected article.

Figure 2:
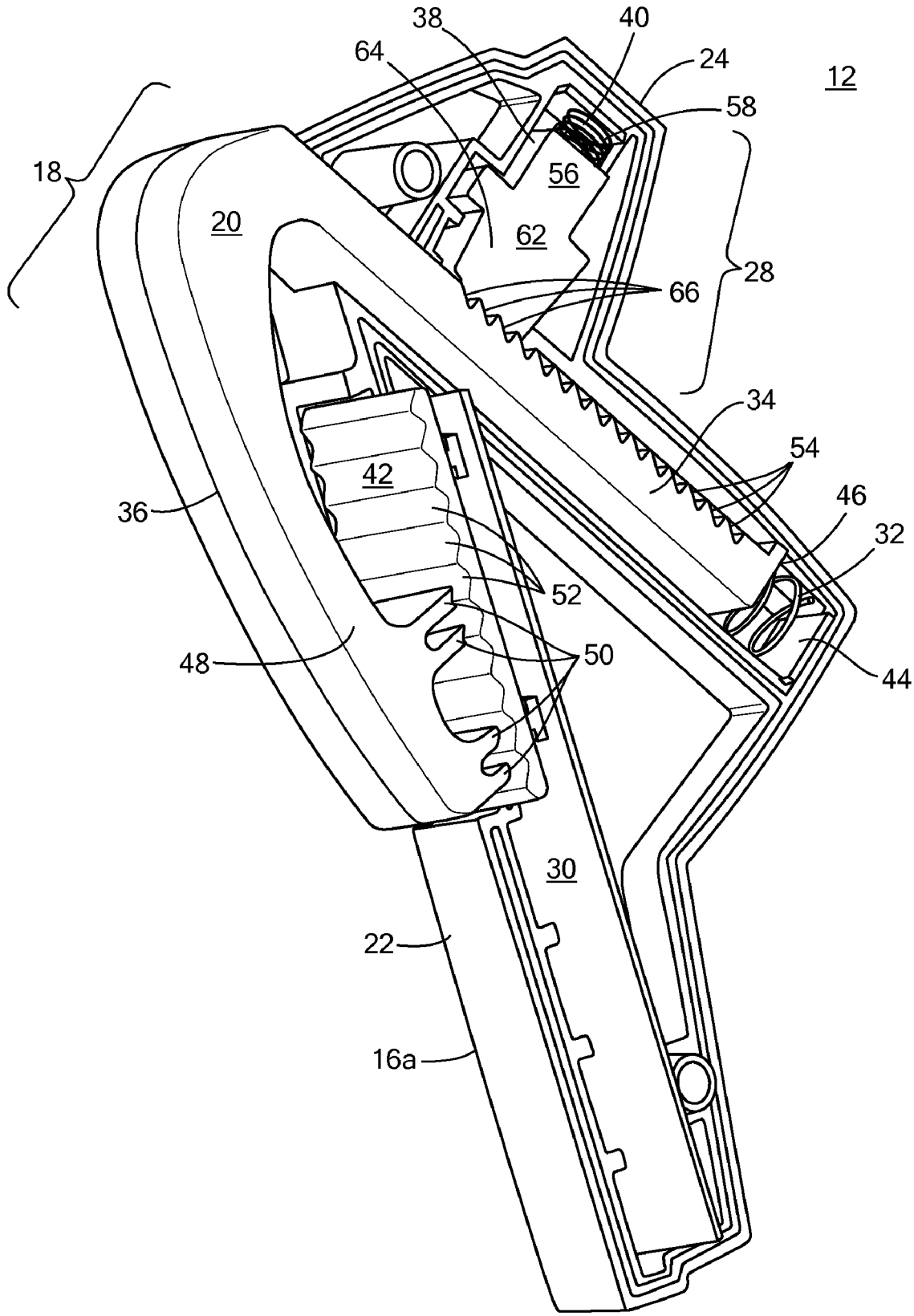
FIG. 2 is a rear/left-side perspective view of a pinless EAS device with the left half of the housing removed, constructed in accordance with one embodiment of the present invention.

Referring now to FIG. 2, a rear/left-side perspective view of a pinless EAS device with the left half 16*b* of the housing removed is provided in accordance with the principles of the present invention. The pinless EAS security device 12 may include a securing mechanism 18, a locking mechanism 28, a detectable security element 30 and a housing 16. The securing mechanism 18 may include a strap 20 and a flexible channel element 32. The strap 20 has a latching side 34 and a securing side 36. The locking mechanism 28 may be a magnetically actuable locking mechanism, and may include a magnetically actuable latch 38 and a flexible locking element 40. The flexible locking element 40, e.g., a spring, in a locked position, is biased to apply an upward force on the magnetically actuable latch 38, thereby causing the magnetically actuable latch 38 to engage the latching side 34 of the securing mechanism 18.

The housing 16 may be any casing or other structure that partially or fully contains and/or surrounds, encloses, affixes to, interlocks with, or otherwise secures the locking mechanism 28 and detectable security element 30, a portion of the securing mechanism 18, and an article when the locking mechanism 28 is in the locking position and the housing 16 is thereby locked. The housing 16 and locking mechanism 28 may thus cooperate to secure, or lock, the article to the housing 16, and thus the security device 12. The housing 16 may be configured as desired, and may be shaped based upon the shapes of the locking mechanism 28, detectable security element 30, and article for which it is designed to secure, such as described below with respect to embodiments of the housing 16. The housing 16 may include a securing pad 42, which may be integral with the housing 16 or may be a separate piece mounted on the securing side 22 of the housing 16. The housing 16 may alternatively be configured to pair with the securing pad 42. The interior of the housing 16 may further comprise a rectangular channel 44 which encompasses a portion of the latching side 34 of the strap 20 and allows the strap 20 to slide along the channel 44. The channel 44 is oriented at an acute angle of approximately 35° with respect to the securing side 36 of the housing 16.

In one embodiment, the strap 20 may comprise or may be formed of a non-magnetic material such as aluminum, plastic or a die-cast alloy. The strap 20 may comprise a "U-shaped" or "V-shaped" element wherein one side of the U (or V) is a latching side 34 and the other side is a securing side 36. The angle between the latching side 34 and the securing side 36 is an acute angle of approximately 20-60°. The latching side 34 partially resides in the housing 16 within the rectangular channel 44. The latching side 34 of the strap 20 slides within the channel 44 to allow the strap 20 to move from an open position to a closed position. A flexible channel element 32 is compressed between the bottom surface 46 of the latching side 34 of the strap and an outer wall of the housing 16, thereby biasing the flexible element 32 to apply an upward force to the bottom surface 46 of the latching side 34 of the strap 20 and causing the strap 20 to tend to rest in an open position. The flexible channel element 32 may be a cylindrical spring, an elliptical spring, a cantilever arm, such as, for example, a leaf spring or any other shape, as long as the flexible channel element 32 serves to apply an upward force on the bottom surface 46 of the latching side 34 of the strap 20.

The securing side 36 of the strap 20 includes an end portion 48 having at least one protrusion 50, such as ribs, ridges, spikes, teeth, etc., extending inward towards the securing side 22 of the housing 16. The amount and type of protrusion 50 may vary depending upon the type of article to be secured. When security device 12 is attached to an article, the strap 20 is moved to a closed position where the article is trapped or sandwiched between the end portion 48 of the securing side 36 of the strap 20 and the securing pad 42 on the securing side 22 of the housing 16. The protrusions 50 of the securing side 36 of the strap 20 "bite" into the material of the article preventing the security tag 12 from being removed without destroying or damaging the detectable security element 30 or article.

The securing pad 42 may also include protrusions, such as rows of teeth or ridges 52 designed to operate in conjunction with the protrusions 50 of the securing side 36 of the strap 20 to securely grip the material of an article and prevent the pinless EAS security device 12 from being removed from the article when the strap 20 is in a locked position. The securing pad 42 may comprise a metal, polymer, ceramic, and/or another material or materials, as long as the material is rigid enough to prevent the housing 16 from being forcibly removed from the article, when secured to the article, without destroying or damaging the detectable security element 30 or article.

The latching side 34 of the strap 20 includes a plurality of parallel ridges 54, such as ribs, teeth, notches, jags, points, curves, voids, or other shapes, which engage the magnetically actuable latch 38 to secure the strap 20 in a locked position and prevent the latching side 34 from being extended from the housing 16. The latching side 34 of the securing mechanism 16 may be configured as desired, such as with one or more holes or other voids, ribs, teeth, protrusions, or other shapes. The latching side 34 may be configured to engage, receive, insert into, or otherwise mate with at least a portion of the magnetically actuable latch 38.

The magnetically actuable latch 38 may include a base portion 56, which may include a base portion end 58 and a latching portion 62 which may include a latching portion end 64. Protruding from the latching portion end 64, the magnetically actuable latch 38 includes one or more teeth 66, ribs, notches, jags, points, curves, voids, or other shapes such as those described herein with respect to embodiments of the magnetically actuable latch 38, while the base portion end 58 may be flat or another shape. In one embodiment, each ridge or tooth 66 may have a rise of approximately 1.36 mm and a run of approximately 0.46 mm. Exemplary ratios of rise to run can be approximately 3:1, 4:1 or 5:2. It is understood however, that these examples are not limiting and that other ratios can be used depending on the design requirements and the object to be secured.

In an embodiment where the magnetically actuable latch 38 is toothed at its latching portion end 64, the latching side 34 of the securing mechanism 16 may be configured with ribs 54 that engage the teeth 66 of the magnetically actuable latch 38 in the locking position. The flexible locking element 40 is biased to exert a force on the base portion end 58 to engage the teeth 66 of the latching portion end 64 into the teeth 54 of the latching side 34 of the strap 20 to prevent the strap 20 from being pulled away from the housing 16. The flexible locking element 40 prevents the base portion 56 from disengaging the latching side 34 of the strap 20 unless the magnetically actuable latch 38 is being pulled away from the latching side 34 by a magnetic force, such as that exerted by a detacher 14.

The flexible locking element 40 may be shaped as desired, such as in a cuboid, ellipsoid, coil, or any other shape such as described herein with respect to the embodiments of the flexible locking element 40 and may include one or more pieces, or may be combined or integrally formed with the magnetically actuable latch 38. In one embodiment, the flexible locking element 40 may be shaped as a cantilever arm, such as, for example, a leaf spring. The flexible locking element 40 may comprise or may be formed of a flexible material such as a light, porous, semi-rigid, elastic, gaseous, and/or spongy material that may provide a resistant force when compressed and may partially or fully recover its uncompressed shape when the compressive force is removed. For example, in various embodiments, the flexible locking element 40 may comprise or may be formed of a foam rubber, polymeric foam, ceramic foam, or other foam; a rubber; and/or another material or materials. The flexible locking element 40 may also or alternatively be configured to provide the resistant force when compressed. For example, in various embodiments the flexible locking element 40 may be configured as a coil, leaf or other cantilevered arm, or other spring, or other like member, that comprises a metal, polymer, ceramic, and/or another material or materials. The flexible locking element 40 may have any of various masses.

Additionally, the combination of forces applied to the strap 20 by the flexible locking element 40 and the flexible channel element 32, in the locked position, produce a torque upon the strap 20 which further serves to allow the securing side 22 of the strap 20 to firmly grip the protected article.

The magnetically actuable latch 38 may be configured as desired, may comprise one or more pieces, and may be symmetrical or unsymmetrical about any point, line, or plane. For example, in various embodiments the magnetically actuable latch 38 may be configured with a "T", "I", curved, or other shape of face and with a rectangular, circular, thick, hollow or otherwise voided, and/or non-uniform cross-section, or as described herein with respect to embodiments of the magnetically actuable latch 38. In addition, the base portion end 58 may be continuous or discontinuous. The magnetically actuable latch 38 may be configured such that at least a portion of it, such as the latching portion 62, may engage, receive, insert into, or otherwise mate with the latching side 34 of the securing mechanism 16, such as described herein.

The magnetically actuable latch 38 may comprise or may be formed of a magnetic material such as iron, nickel, or cobalt, or an alloy of iron, nickel, or cobalt. In one embodiment, the magnetically actuable latch 38 includes one or more magnetic materials and may also include one or more non-magnetic materials.

In one embodiment, the magnetically actuable latch 38 and the flexible locking element 40 are contained within the protrusion 24 of the housing 16 opposite the securing side 22. The protrusion 24 is designed to fit into an indented detaching zone 26 of the magnetic tag detacher 14 (FIG. 1) in order to remove the pinless EAS security tag 12 from the protected article. The magnetic tag detacher 14 applies a magnetic field which attracts the magnetically actuable latch 38 with enough force to overcome the upward force supplied by the flexible locking element 40 such that the ridges or teeth 66 of the magnetically actuable latch 38 disengage from the ridges or teeth 54 of the latching side 34 of the strap 20, thereby allowing the strap 20 to move freely in the channel 44 and releasing the article.

The detectable security element 30 is positioned within a chamber in the housing 16 and may be any detectable device or system, such as any security tag or label. For example, in various embodiments the detectable security element 30 may be any type of EAS element (e.g., Radio Frequency element, acousto-magnetic element, etc.), Radio Frequency Identification ("RFID") element, combination EAS/RFID element, smart tag, or other detectable anti-theft or other security element. Of note, although the present invention is described with reference to an "EAS system" using "EAS tags" these terms are used in the general sense and include tags that use one or security elements, e.g., EAS element, RFID element, etc. The detectable security element 30 may be detectable by a corresponding detecting system or device, such as, depending on the type of security tag or label, an acousto-magnetic detector, electromagnetic detector, radio frequency detector, or other detector.

Figure 3:
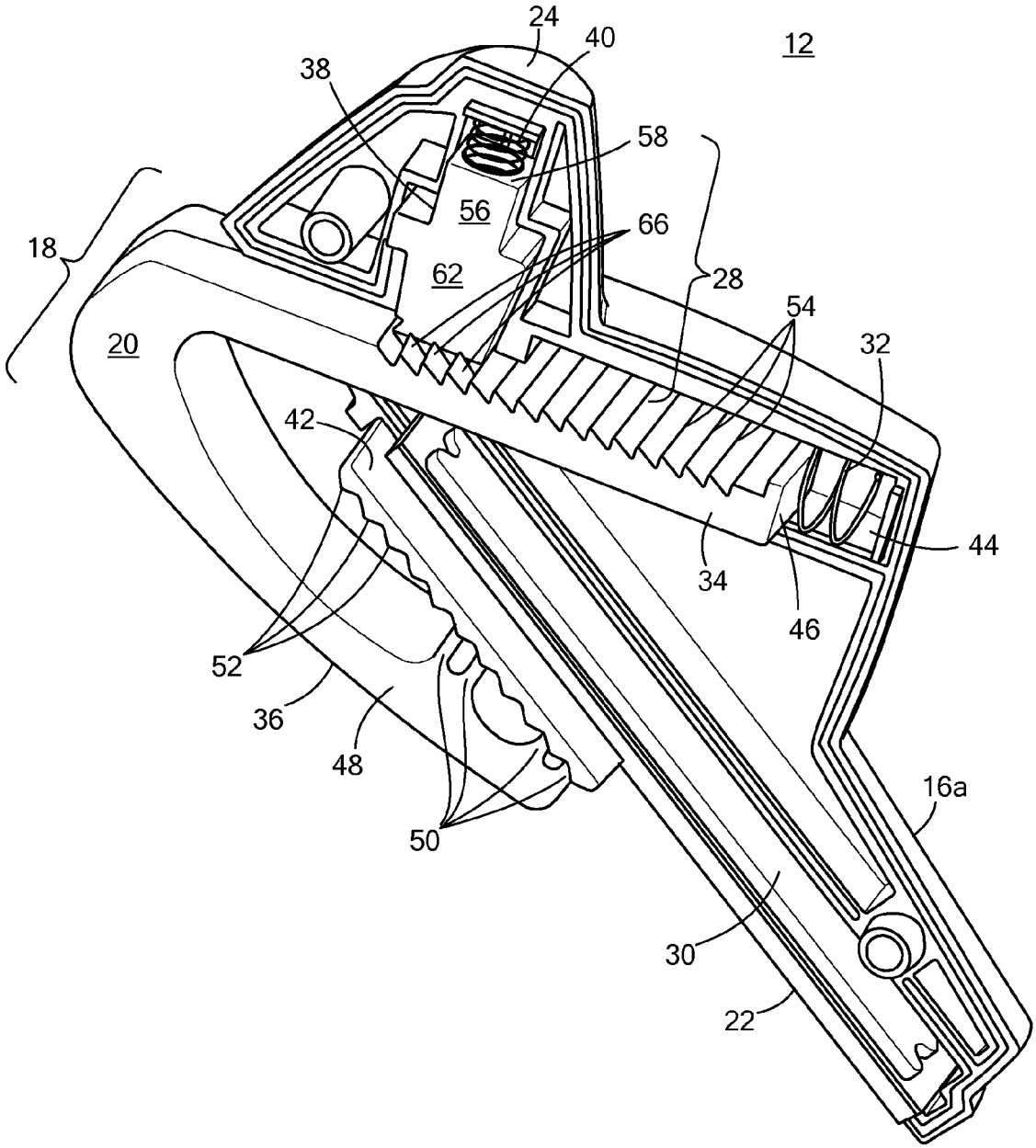
FIG. 3 is a left-side/front perspective view of a pinless EAS device with the left half of the housing removed, constructed in accordance with one embodiment of the present invention.
Figure 4:
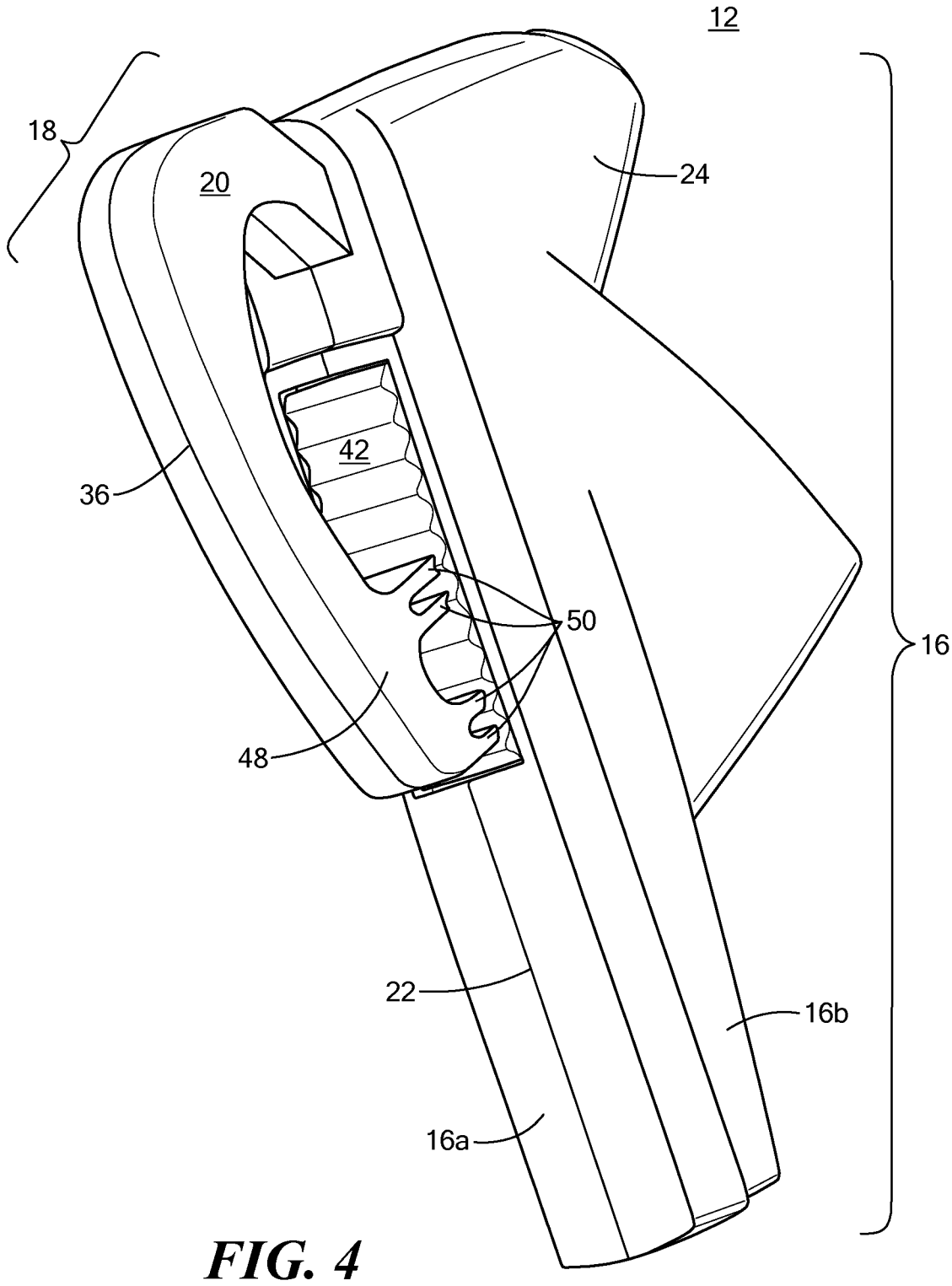
FIG. 4 is a rear/left-side perspective view of a pinless EAS device constructed in accordance with one embodiment of the present invention.

FIG. 3 illustrates a left-side/front perspective view of a pinless EAS device 12 with the left half 16*b* of the housing removed. FIG. 4 illustrates a rear/left-side perspective view of a pinless EAS device 12 constructed in accordance with one embodiment of the present invention. In the embodiment shown in FIGS. 1-4, the detectable security element 30 is oriented such that the longitudinal axis of the detectable security element 30 lies in the same plane as the strap 20 (hereinafter referred to as a "vertical embodiment").

Figure 5:
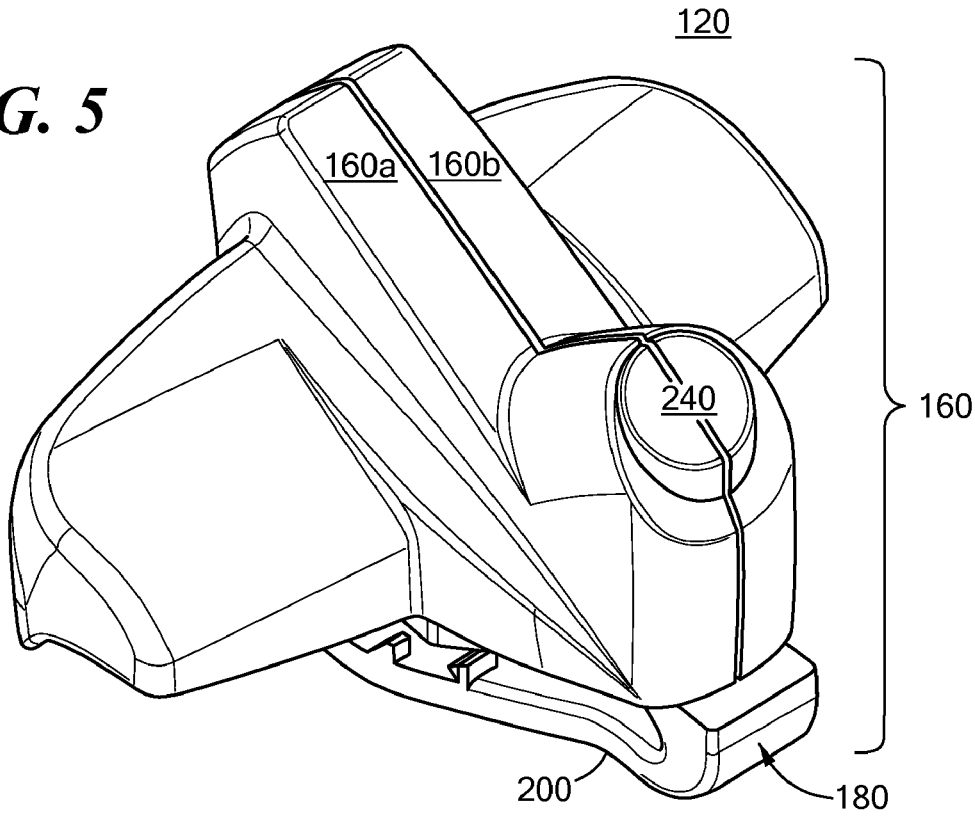
FIG. 5 is a top/right-side/front perspective view of a pinless EAS device constructed in accordance with an alternative embodiment of the present invention.

Referring now to FIG. 5, an alternative embodiment of a pinless EAS security tag 120 is provided in accordance with the principles of the present invention. In contrast to EAS security tag 12, the longitudinal axis of the detectable security element 300 lies in a plane perpendicular to the strap 200 (hereinafter referred to as a "horizontal embodiment").

The horizontal embodiment of a pinless EAS security tag 120 may include a housing 160 having two conjoining halves 160*a*, 160*b* molded from a polymer and/or another material or materials. A securing mechanism 180, such as a strap 200, is movable between an open position and a locked position. When security device 120 is attached to an article, the strap 200 is moved to the closed position where the article is trapped or sandwiched between the strap 200 and a securing side 220 of the housing 160.

The housing 160 further includes a protrusion 240 designed to fit into an indented detaching zone 26 of a magnetic tag detacher 14 in order to remove the pinless EAS security tag 120 from the protected article.

Figure 6:
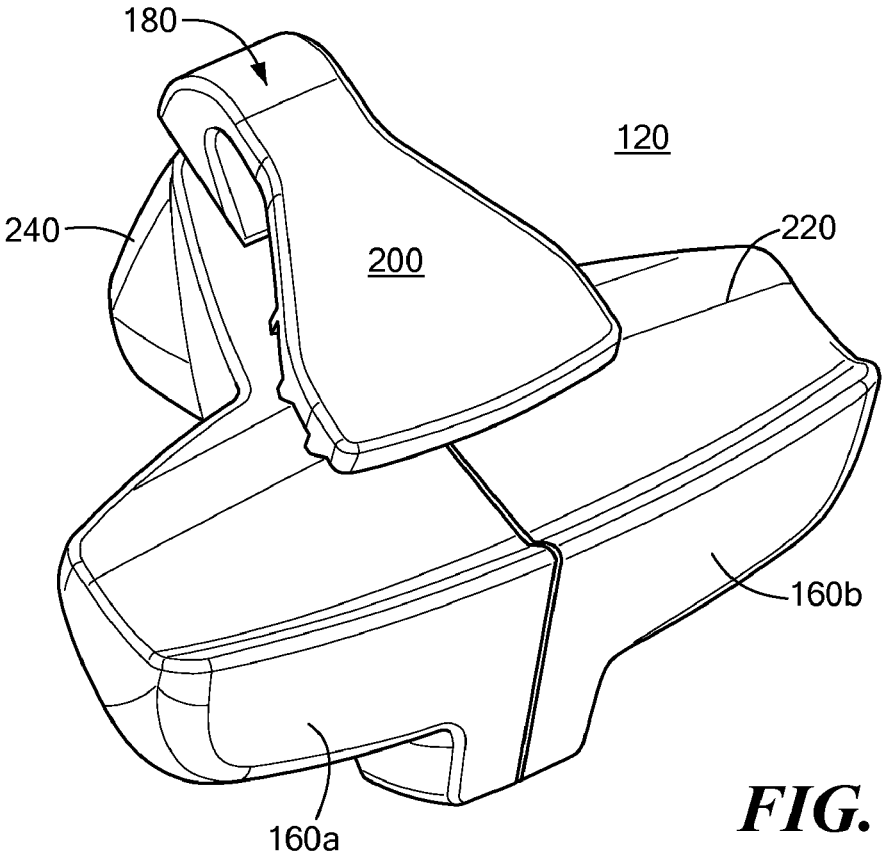
FIG. 6 is a bottom/right-side/front perspective view of a pinless EAS device constructed in accordance with an alternative embodiment of the present invention.

FIG. 6 illustrates a bottom/right-side/front perspective view of a pinless EAS device constructed in accordance with an alternative embodiment of the present invention.

Figure 7:
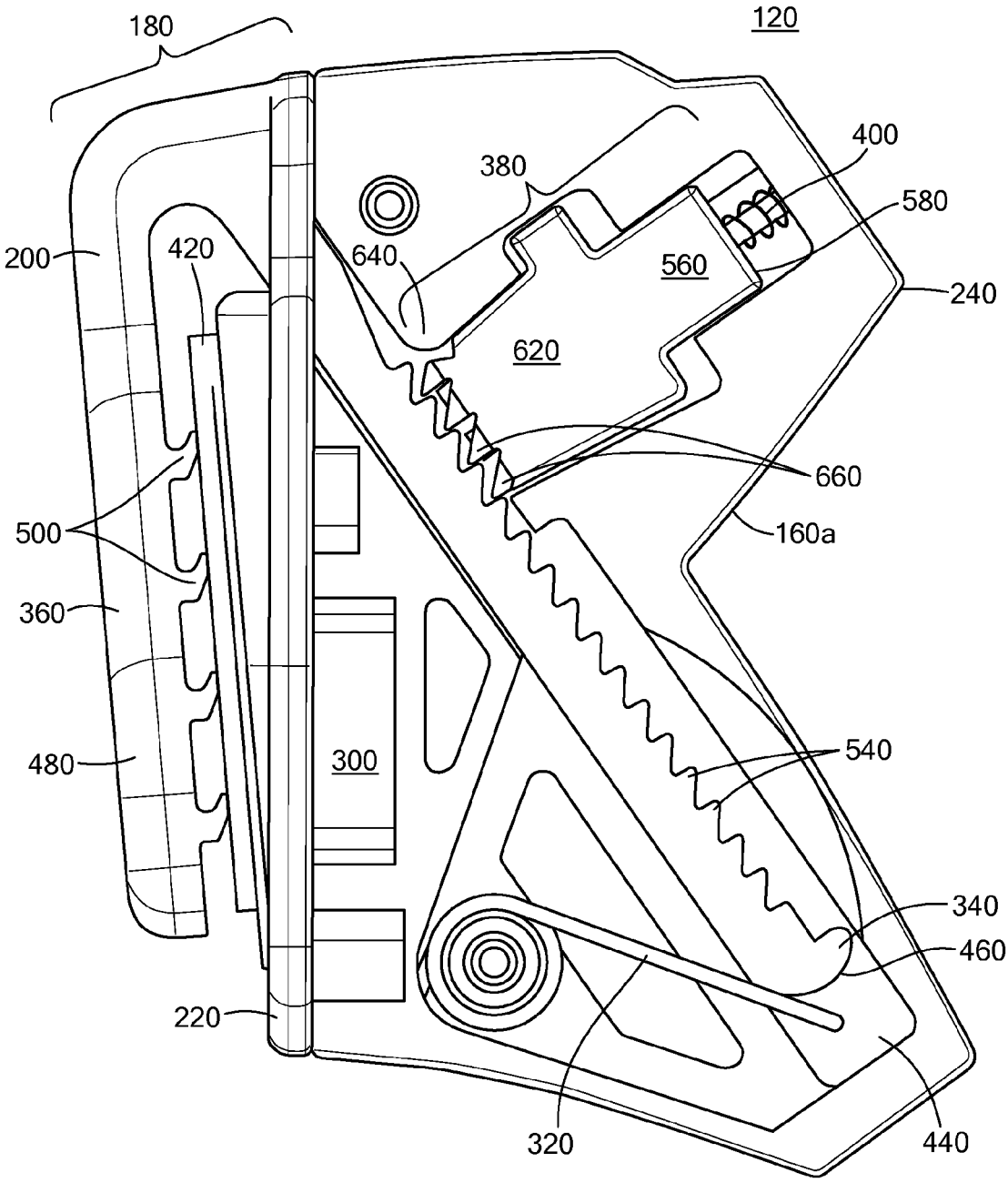
FIG. 7 is a right-side view of a pinless EAS device with the right half of the housing removed, constructed in accordance with an alternative embodiment of the present invention.

Referring now to FIG. 7 a right-side view of a pinless EAS security device 120 with the right half 160*b* of the housing 160 removed is provided in accordance with the principles of the present invention. Pinless EAS security device 120 may include a securing mechanism 180, a locking mechanism 280, a detectable security element 300 and a housing 160. The securing mechanism 180 may include a strap 200 and a flexible channel element 320. The strap 200 has a latching side 340 and a securing side 360. The locking mechanism 280 may be a magnetically actuable locking mechanism, and may include a magnetically actuable latch 380 and a flexible locking element 400. The flexible locking element 400, e.g., a spring, in a locked position, is biased to apply an upward force on the magnetically actuable latch 380, thereby causing the magnetically actuable latch 380 to engage the latching side 340 of the securing mechanism 180.

The housing 160 may be any casing or other structure that partially or fully contains and/or surrounds, encloses, affixes to, interlocks with, or otherwise secures the locking mechanism 280 and detectable security element 300, a portion of the securing mechanism 180, and an article when the locking mechanism 280 is in the locking position and the housing 160 is thereby locked. The housing 160 and locking mechanism 280 may cooperate to secure, or lock, the article to the housing 160, and thus the security device 120. The housing 160 may be configured as desired, and may be shaped based upon the shapes of the locking mechanism 280, detectable security element 300, and article for which it is designed to secure, such as described below with respect to embodiments of the housing 160. The housing 160 may include a securing pad 420, which may be integral with the housing 160 or may be a separate piece mounted on the securing side 220 of the housing 160. The housing 160 may alternatively be configured to pair with the securing pad 420. The interior of the housing 160 may further comprise a rectangular channel 440 which encompasses a portion of the latching side 340 of the strap 200 and allows the strap 200 to slide along the channel 440.

In one embodiment, the strap 200 may comprise or may be formed of a non-magnetic material such as extended aluminum or poly-carbonate. The strap 200 may comprise a "U-shaped" or "V-shaped" element wherein one side of the U (or V) is a latching side 340 and the other side is a securing side 360. The angle between the latching side 340 and the securing side 360 is an acute angle of approximately 30-60°. The latching side 340 partially resides in the housing 160 within the rectangular channel 440. The latching side 340 of the strap 200 slides within the channel 440 to allow the strap 200 to move from an open position to a closed position. A flexible channel element 320 is compressed between the bottom surface 460 of the latching side 340 of the strap and an outer wall of the housing 160, thereby biasing the flexible element 320 to apply an upward force to the bottom surface 460 of the latching side 340 of the strap 200 and causing the strap 200 to tend to rest in an open position. The flexible channel element 320 may be a cylindrical spring, an elliptical spring, a cantilever arm, such as, for example, a leaf spring or any other shape, as long as the flexible channel element 320 serves to apply an upward force on the bottom surface 460 of the latching side 340 of the strap 200.

The securing side 360 of the strap 200 includes an end portion 480 having at least one protrusion 500, such as ribs, ridges, spikes, teeth, etc., extending back towards the securing side 240 of the housing 160. The amount and type of protrusion 500 may vary depending upon the type of article to be secured. When security device 120 is attached to an article, the strap 200 is moved to a closed position where the article is trapped or sandwiched between the end portion 480 of the securing side 360 of the strap 200 and the securing pad 420 on the securing side 240 of the housing 160. The protrusions 500 of the securing side 360 of the strap 200 "bite" into the material of the article preventing the security tag 120 from being removed without destroying or damaging the detectable security element 300 or article.

The securing pad 420 may also include protrusions, such as rows of teeth or ridges (not shown) designed to operate in conjunction with the protrusions 500 of the securing side 360 of the strap 200 to securely grip the material of an article and prevent the pinless EAS security device 120 from being removed from the article when the strap 200 is in a locked position. The securing pad 420 may comprise a metal, polymer, ceramic, and/or another material or materials, as long as the material is rigid enough to prevent the housing 160 from being forcibly removed from the article, when secured to the article, without destroying or damaging the detectable security element 300 or article.

The latching side 340 of the strap 200 includes a plurality of parallel ridges 540, such as ribs, teeth, notches, jags, points, curves, voids, or other shapes, which engage the magnetically actuable latch 380 to secure the strap 200 in a locked position and prevent the latching side 340 from being extended from the housing 160. The latching side 340 of the securing mechanism 160 may be configured as desired, such as with one or more holes or other voids, ribs, teeth, protrusions, or other shapes. The latching side 340 may be configured to engage, receive, insert into, or otherwise mate with at least a portion of the magnetically actuable latch 380.

The magnetically actuable latch 380 may include a base portion 560, which may include a base portion end 580 and a latching portion 620 which may include a latching portion end 640. Protruding from the latching portion end 640, the magnetically actuable latch 380 includes one or more teeth 660, ribs, notches, jags, points, curves, voids, or other shapes such as those described herein with respect to embodiments of the magnetically actuable latch 380, while the base portion end 580 may be flat or another shape.

In an embodiment where the magnetically actuable latch 380 is toothed at its latching portion end 640, the latching side 340 of the securing mechanism 160 may be configured with ribs 540 that engage the teeth 660 of the magnetically actuable latch 380 in the locking position. The flexible locking element 400 is biased to exert a force on the base portion end 580 to engage the teeth 660 of the latching portion end 640 into the teeth 540 of the latching side 340 of the strap 200 to prevent the strap 200 from being pulled away from the housing 160. The flexible locking element 400 prevents the base portion 560 from disengaging the latching side 340 of the strap 200 unless the magnetically actuable latch 380 is being pulled away from the latching side 340 by a magnetic force, such as that exerted by a detacher 14.

The flexible locking element 400 may be shaped as desired, such as in a cuboid, ellipsoid, coil, or any other shape such as described herein with respect to the embodiments of the flexible locking element 400 and may include one or more pieces, or may be combined or integrally formed with the magnetically actuable latch 380. In one embodiment, the flexible locking element 400 may be shaped as a cantilever arm, such as, for example, a leaf spring. The flexible locking element 400 may comprise or may be formed of a flexible material such as a light, porous, semi-rigid, elastic, gaseous, and/or spongy material that may provide a resistant force when compressed and may partially or fully recover its uncompressed shape when the compressive force is removed. For example, in various embodiments, the flexible locking element 400 may comprise or may be formed of a foam rubber, polymeric foam, ceramic foam, or other foam; a rubber; and/or another material or materials. The flexible locking element 400 may also or alternatively be configured to provide the resistant force when compressed. For example, in various embodiments the flexible locking element 400 may be configured as a coil, leaf or other cantilevered arm, or other spring, or other like member, that comprises a metal, polymer, ceramic, and/or another material or materials. The flexible locking element 400 may have any of various masses.

Additionally, the combination of forces applied to the strap 200 by the flexible locking element 400 and the flexible channel element 320, in the locked position, produce a torque upon the strap 200 which further serves to allow the securing side 220 of the strap 200 to firmly gri the protected article.

The magnetically actuable latch 380 may be configured as desired, may comprise one or more pieces, and may be symmetrical or unsymmetrical about any point, line, or plane. For example, in various embodiments the magnetically actuable latch 380 may be configured with a "T", "I", curved, or other shape of face and with a rectangular, circular, thick, hollow or otherwise voided, and/or non-uniform cross-section, or as described herein with respect to embodiments of the magnetically actuable latch 380. In addition, the base portion end 580 may be continuous or discontinuous. The magnetically actuable latch 380 may be configured such that at least a portion of it, such as the latching portion 620, may engage, receive, insert into, or otherwise mate with the latching side 340 of the securing mechanism 160, such as described herein.

The magnetically actuable latch 380 may comprise or may be formed of a magnetic material such as iron, nickel, or cobalt, or an alloy of iron, nickel, or cobalt. In one embodiment, the magnetically actuable latch 380 includes one or more magnetic materials and may also include one or more nonmagnetic materials.

In one embodiment, the magnetically actuable latch 380 and the flexible locking element 400 are contained within the protrusion 240 of the housing 160 opposite the securing side 220. The protrusion 240 is designed to fit into an indented detaching zone 26 of the magnetic tag detacher 14 (FIG. 1) in order to remove the pinless EAS security tag 12 from the protected article. The magnetic tag detacher 14 applies a magnetic field which attracts the magnetically actuable latch 380 with enough force to overcome the upward force supplied by the flexible locking element 400 such that the ridges or teeth 660 of the magnetically actuable latch 38 disengage from the ridges or teeth 540 of the latching side 34 of the strap 200, thereby allowing the strap 200 to move freely in the channel 440 and releasing the article.

The detectable security element 300 may be any detectable device or system, such as any security tag or label. For example, in various embodiments the detectable security element 300 may be any type EAS element (e.g., Radio Frequency element, acousto-magnetic element, etc.), Radio Frequency Identification ("RFID") element, combination EAS/RFID element, smart tag, or other detectable anti-theft or other security element. Of note, although the present invention is described with reference to an "EAS system" using "EAS tags" these terms are used in the general sense and include tags that use one or security elements, e.g., EAS element, RFID element, etc. The detectable security element 300 may be detectable by a corresponding detecting system or device, such as, depending on the type of security tag or label, an acousto-magnetic detector, electromagnetic detector, radio frequency detector, or other detector.

Figure 8:
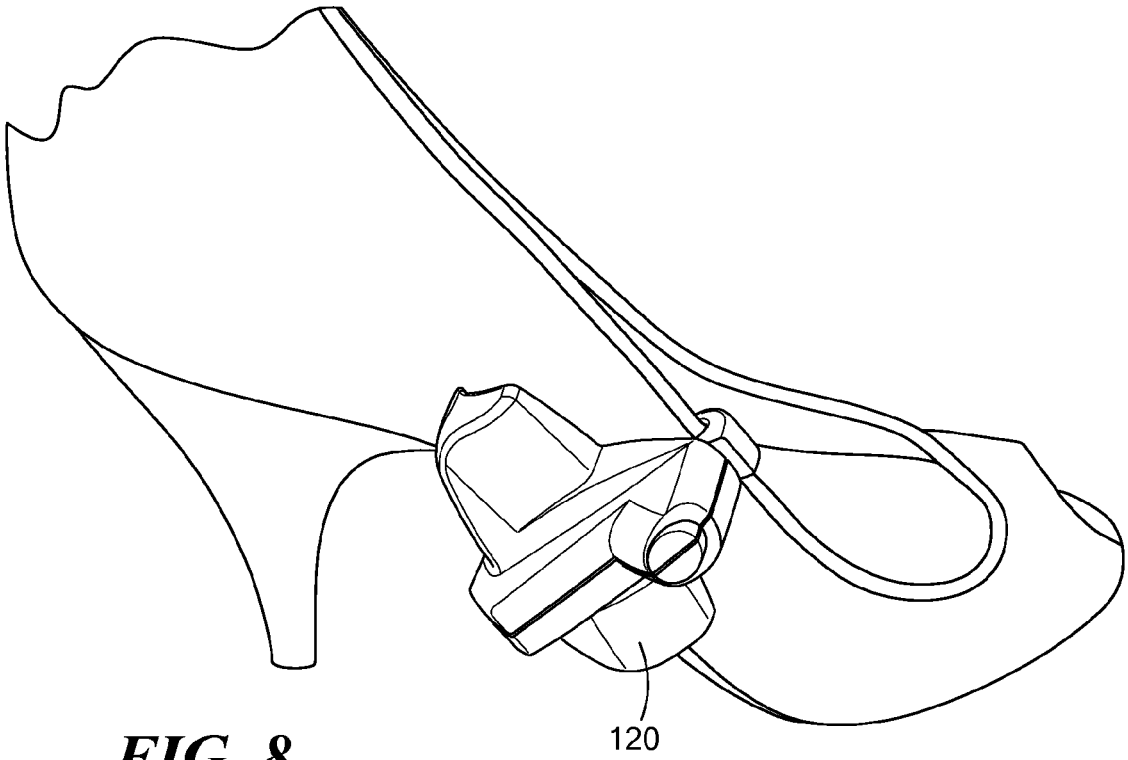
FIG. 8 is an illustration showing a pinless EAS device attached to a shoe, in accordance with one embodiment of the present invention.
Figure 9:
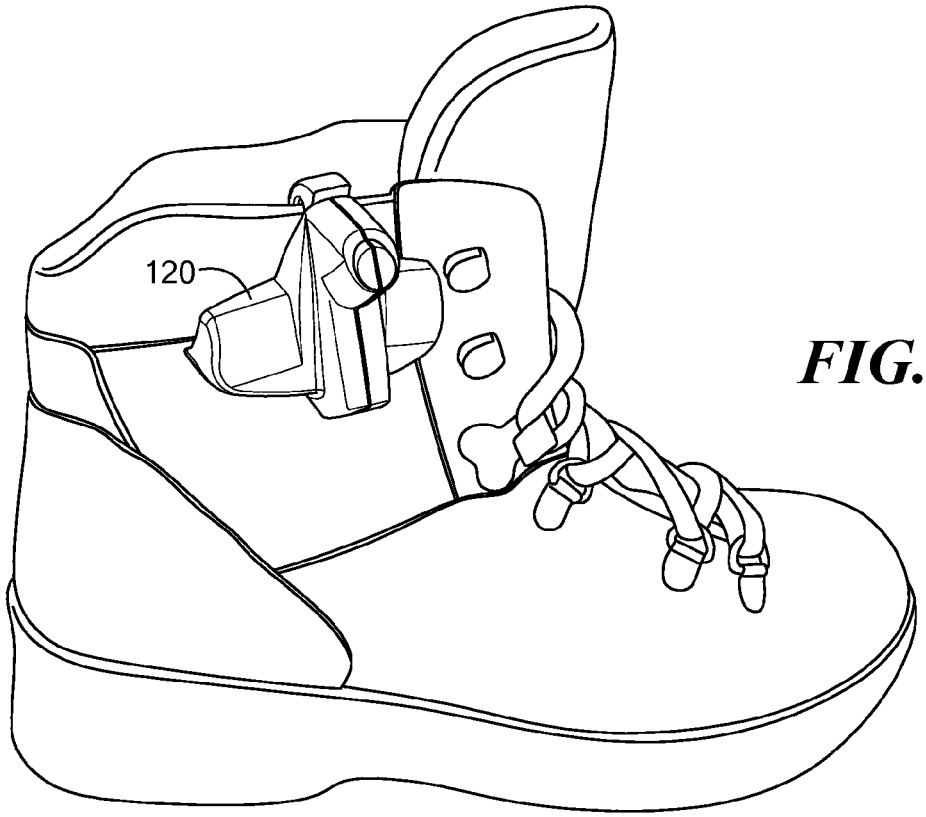
FIG. 9 is an illustration showing a pinless EAS device attached to a boot, in accordance with one embodiment of the present invention.
Figure 10:
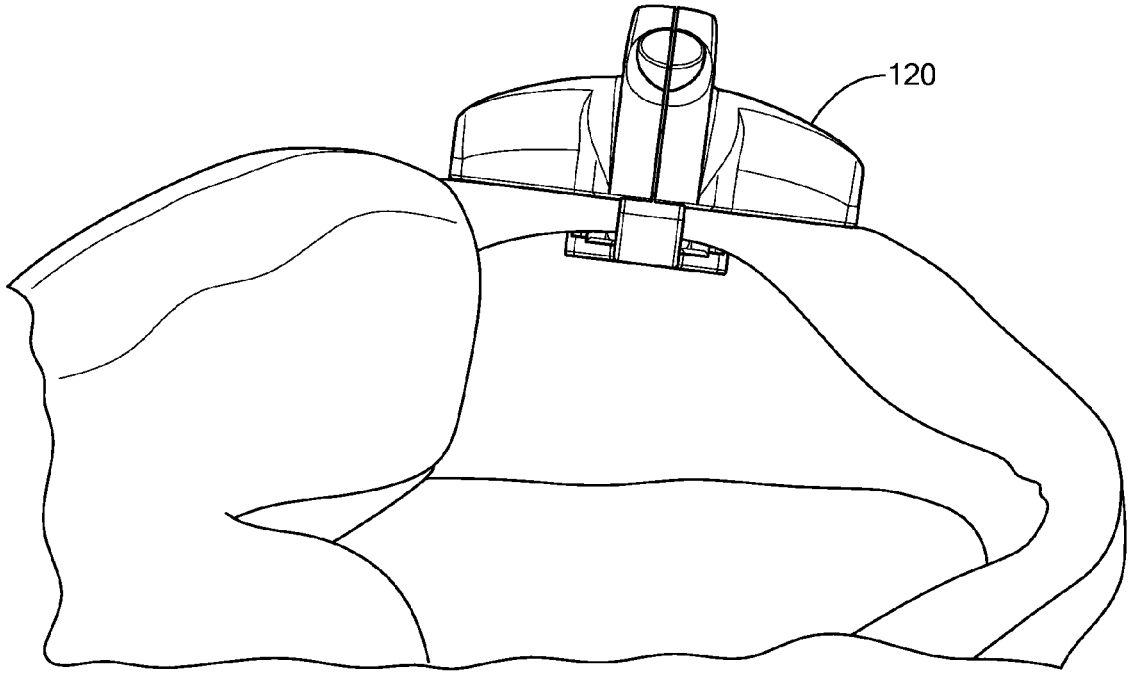
FIG. 10 is an illustration showing a view of the interior of the boot of FIG. 9.

Referring now to FIG. 8, a horizontal embodiment of a pinless EAS security device 120 is illustrated in use while attached to a woman's shoe. FIGS. 9 and 10 illustrate a horizontal embodiment of a pinless EAS security device 120 while attached to a boot. As may be noted from FIGS. 8-10, embodiments of the present invention allow a customer to try on the item of merchandise with minimal interference from the pinless EAS security device, while advantageously providing the assurance of protection against theft for the retailer.

Of note, although the present invention is described with reference to capturing a portion of an article to be secured between the contact pad on the housing and the securing region on the strap, use of the present invention is not limited to such. For example, where an article has an opening or an element with an opening such as a handbag strap, handle, ring or belt buckle, the strap of the security tag can be inserted through the opening in the article such that, when in the locked position, the securing region contacts the securing pad thereby locking the security tag to the article.

Unless mention was made above to the contrary, it should be noted that all of the accompanying drawings are not to scale. Significantly, this invention can be embodied in other specific forms without departing from the spirit or essential attributes thereof, and accordingly, reference should be had to the following claims, rather than to the foregoing specification, as indicating the scope of the invention.

What is claimed is:

1. A security device, removably affixable to an article, the security device comprising;

a housing including:

an exterior securing side;

an interior channel having an opening adjacent the exterior securing side, the channel oriented at an acute angle with respect to the exterior securing side; and a locking element disposed within the housing adjacent the interior channel; and a rigid bifurcated strap with diverging first and second arms, the first and second arms defining an inside surface therebetween, the first arm being insertable into the channel in the housing and having a latching region engagable with the-locking element of the housing, the second arm having a distal end with the inside surface of the second arm proximate the end including a securing region having at least one protrusion extending therefrom, the protrusion configured and positioned to contact the exterior securing side of the housing when the first arm is inserted into the channel;

the strap slidingly movable within the channel between an open position and a locked position in which the first arm is retained within the channel, the retention of first arm within the channel causing the securing region of the second arm to exert compressive force against the securing side, wherein moving the strap into the locked position compresses the securing region into the exterior securing side of the housing to secure a portion of the article therebetween.

2. The security device of claim 1, wherein the exterior securing side of the housing includes a securing pad extending outwardly therefrom, the securing pad cooperating with the at least one protrusion to grip the portion of the article positioned therebetween.

3. The security device of claim 1, wherein the securing pad has a contoured surface configured for engagement with the at least one protrusion.

4. The security device of claim 1, wherein the securing pad is intregally formed with the exterior security side.

5. The security device of claim 1, wherein the securing pad is mounted on the securing side.

6. The security device of claim 1, wherein the exterior securing side of the housing includes a securing pad extending outwardly therefrom, the securing pad cooperating with the at least one protrusion to grip the portion of the article positioned therebetween.

7. The security device of claim 1, wherein the locking element includes:

a magnetically actuable latch; and a flexible locking element biasing the magnetically actuable latch and the latching region of the strap into a locked position.

8. The security device of claim 7, wherein the latching region of the strap includes structure to engage with the magnetically actuable latch.

9. The security device of claim 8, wherein the structure to engage with the magnetically actuable latch includes a plurality of parallel teeth.

10. The security device of claim 1 further comprising a;

a flexible channel element positioned within the channel of the housing exerting a force on the strap, wherein the flexible locking element, in combination with the flexible channel element, creates a torque on the strap such that a portion of the article is more firmly gripped between the securing side of the housing and the securing region of the strap when in the locked position.

11. The security device of claim 1, wherein the channel is oriented at an acute angle of substantially 20° to substantially 60° with respect to the securing side of the housing.

12. The security device of claim 1, wherein the strap has V-shaped configuration.

13. The security device of claim 1, wherein the housing further includes a detectable security element chamber and wherein the security device further includes a detectable security element located in the detectable security element chamber.

14. The security device of claim 13, wherein the detectable security element is at least one of an Electronic Article Surveillance ("EAS") tag and a Radio Frequency Identification ("RFID") tag.

15. The security device of claim 13, wherein the securing region and the latching region of the strap lie in a first plane, a longitudinal axis of the detectable security element lies in the first plane.

16. The security device of claim 13, wherein the securing region and the latching region of the strap lie in a first plane, a longitudinal axis of the detectable security element lies in a second plane, the second plane being perpendicular to the first plane.

17. An electronic article surveillance ("EAS") system for securing an article, comprising:

an EAS security device including:

a housing including:

an exterior securing side;

an interior channel having an opening adjacent the exterior securing side, the channel oriented at an acute angle with respect to the securing side; and a locking element disposed within the housing adjacent the interior channel; and a rigid bifurcated strap with diverging first and second arms, the first and second arms defining an inside surface therebetween, the first arm being insertable into the channel in the housing and having a latching region engagable with the locking element of the housing, the second arm having a distal end with the inside surface of the second arm proximate the end including a securing region having at least one protrusion extending therefrom, the protrusion configured and positioned to contact the exterior securing side of the housing when the first arm is inserted into the channel;

the strap slidingly movable within the channel between an open position and a locked position in which the first arm is retained within the channel, the retention of first arm within the channel causing the securing region of the second arm to exert compressive force against the securing side, wherein moving the strap into the locked position compresses the securing region into the exterior securing side of the housing to secure a portion of the article therebetween; and a magnetic detacher including a detaching zone, the detaching zone operable to nest the protrusion of the housing therein for detaching the EAS security device from the article.

18. The EAS system of claim 17, wherein the EAS security device farther comprises:

a flexible channel element positioned within the channel of the housing exerting a force on the strap to bias the strap into an open position, wherein the flexible locking element, in combination with the flexible channel element, creates a torque on the strap such that a portion of the article is more firmly gripped between the securing region of the strap and the securing side of the housing when in the locked position, without penetrating the article.

19. The EAS system of claim 17, wherein the locking element includes:

a magnetically actuable latch; and a flexible locking element biasing magnetically actable latch and the latching region of the strap into a locked position.

20. The EAS system of claim 19, wherein the channel is oriented at an acute angle of substantially 20° to substantially 60° with respect to the securing side of the housing.

21. A method for protecting an article from theft, the method comprising:

affixing a security device to a portion of the article, the security device including:

a housing including:

an exterior securing side;

an interior channel having an opening adjacent the exterior securing side, the channel oriented at an acute angle with respect to the securing side; and a locking element disposed within the housing adjacent the interior channel, the locking element including a magnetically actuable latch; and a flexible locking element biasing the magnetically actuable latch and the latching region of the strap into a locked position; and a rigid bifurcated strap with diverging first and second arms, the first and second arms defining an inside surface therebetween, the first arm being insertable into the channel in the housing and having a latching region engagable with the locking element of the housing, the second arm having a distal end with the inside surface of the second arm proximate the end including a securing region having at least one protrusion extending therefrom, the protrusion configured and positioned to contact the exterior securing side of the housing when the first arm is inserted into the channel;

slidingly moving the strap within the channel between an open position and a locked position in which the first arm is retained within the channel, the retention of first arm within the channel causing the securing region of the second arm to exert compressive force against the securing side; and securing a portion of the article between the securing region and the exterior securing side of the housing by moving the strap into the locked position.

* * * * *